United States Patent [19]

Breslin

[11] Patent Number: 5,004,405

[45] Date of Patent: Apr. 2, 1991

[54] PNEUMATICALLY POWERED SUBMERSIBLE FLUIDS PUMP WITH INTEGRATED CONTROLS

[76] Inventor: Michael K. Breslin, 1615 Vendola Dr., San Rafael, Calif. 94903

[21] Appl. No.: 388,688

[22] Filed: Aug. 2, 1989

[51] Int. Cl.[5] ..... F04F 1/06

[52] U.S. Cl. ..... 417/131; 417/126; 417/40

[58] Field of Search ..... 417/101, 138, 126, 130, 417/133, 136, 139, 143, 134, 131, 40

[56] References Cited

U.S. PATENT DOCUMENTS

| | | | |
|---|---|---|---|
| 778,608 | 12/1904 | Rogers | 417/101 |
| 1,335,792 | 4/1920 | Muzzy | 417/130 |
| 1,338,323 | 4/1920 | Muzzy | 417/130 |
| 1,708,861 | 4/1929 | Barkeij | 417/130 |

*Primary Examiner*—Leonard E. Smith
*Assistant Examiner*—Robert N. Blackmon

[57] ABSTRACT

Apparatus for the pumping of fluids from a source without the need of external controls. The pump will continue to fill and empty itself as long as there is fluid filling the pump and compressed air of sufficient pressure to overcome the head against which the pump is pushing fluid.

5 Claims, 6 Drawing Sheets

PNEUMATICALLY POWERED SUBMERSIBLE FLUIDS PUMP WITH INTEGRATED CONTROLS

FIELD OF THE INVENTION The invention relates to the pumping of fluids using compressed air as a power source where the cycling of the pump is controlled by sensing the fluid level within the pump.

BACKGROUND OF THE INVENTION

Proposals have been made in the past to provide a pumping system which would automatically sense the presence of liquid and then pump them from one location to another. One such device, which has been in use for years is the combining of an air-driven double diaphragm pump and a pneumatic bubbler/air valve. This kind of system is available from Air Pump Company of Grand Blanc, Michigan, USA. This system requires the use of a double diaphragm pump which is generally larger than 12 inches in diameter and is used to suck fluids from one location and push them to another. This type of system is limited since it can only draw fluid up from about 25 feet depth and to reach greater depths, the pump must be lowered into a rather large well, sump or opening. In addition, the nature of the pump's mechanical action makes it an inefficient pump to use.

Another system utilizes internal controls to operate pneumatic valves and pressurize and exhaust the pump based upon the fullness of the pump. Such a system is disclosed in U.S. Pat. No. 4,467,831 to French, issued August 28, 1984. This system utilizes a displacer to load and unload spring-loaded opposing poppets and thus cause the pump body to pressurize and exhaust. This system has several inherent defects which make the use of the system fraught with maintenance and control problems. A delicate balance between the displacer weight, spring tension and friction which holds the poppets to the o-rings, in which they seat must be maintained if the pump is to function. Too much pressure on either the lower or upper poppet can cause the poppet to jam into the o-ring and "freeze" the pump. If the pressure is not great enough on the upper poppet, the spring tension can lift it off its seat and cause air to constantly stream into the pump and out its exhaust. In practice the pressure range in which this design can operate when the pump must operate within a 4-inch well casing or smaller spans about 40 psi. If the pressure to be used falls or rises outside of this range, the internals of the pump must be adjusted to accommodate such operation or the pump will fail to operate This can be a severe problem if the pressure to the pump fluctuates or the head against which the fluid is being pumped increases. In addition, when the pump is introducing pressurized air into the pump chamber to push out fluid, some of this air bleeds off out the exhaust. This causes a loss of energy. If the pump is constructed so that fluid enters through a check valve at the base of the pump, a fast influx of fluid can unweight the displacer and cause the poppets to shift. When this happens, pressurized air forces the fluid out of the pump, moving the displacer down and reseating the poppets. This action is repeated rapidly and a "stuttering" or "quick cycle" is developed. When this condition is reached, the pump rate and efficiency decreases dramatically. In addition, the friction of the o-rings against the poppets can change if the chemicals which are being pumped cause the o-rings to become lubricated or swell. This can cause the valving mechanism to shift too soon or not at all.

None of the pumping systems described above discloses apparatus and method for pumping fluid which uses a float inside of a canister which trips a pivot arm and thus alternately pressurizes and exhausts a pump chamber. None of the above systems are designed such that they can operate inside of a small volume such as a 4-inch internal diameter well casing at pressures ranges from 10 to 125 psi without adjustment to the mechanisms of operation.

None of the above systems described disclose apparatus and method which utilize a pivot arm which action opens and closes the air valves and after it has been set in motion via the travel of the float, it will complete its travel thus switching the valves which either pressurize or exhaust the pump chamber.

None of the above systems described disclose apparatus and method which has direct air contact against the fluid being pumped and does not cause a bleed of compressed air out of the exhaust of the pump when the pump is pressurizing the pump chamber.

None of the above systems described disclose apparatus and method which has direct air contact against the fluid being pumped and prevents the rapid stuttering of the pumping mechanism if fluid were to rush into a lower check valve after the pump was exhausted of compressed air.

SUMMARY OF THE INVENTION

The present invention fills the aforesaid need by providing an improved apparatus for pumping of fluids from one location to another using compressed air or other gases. The invention requires no pneumatic bubblers to instigate pumping action, nor requires timers to govern the pumping cycle, nor is it susceptible to stuttering due to rapid influx of fluid into its lower extremity.

In carrying out the method of the present invention, the pump is submerged in a fluid in a sump or well. A conduit to supply compressed air to the pump, a conduit to carry the exhausted air away from the pump and a conduit to carry fluid away from the pump are attached to the pump. The pump is suspended vertically in the sump or well and compressed air or sufficient pressure to overcome the head against which the pump must move fluid is applied to the pump via the appropriate conduit. Fluid enters the pump via force of gravity through a check valve in the pump's lowermost extremity. Air is thereby pushed out of the exhaust conduit as the fluid fills the pump chamber. When the float rises inside the pump chamber and triggers the pneumatic valve, the exhaust is shut and compressed air is allowed to enter the pump chamber via the compressed air conduit. This pressure on the fluid in the pump chamber pushes the fluid up, out of the pump through the fluid discharge conduit attached to the pump and through a check valve so the fluid will not re-enter the pump. When the fluid level in the pump has been lowered sufficiently, because it is being pushed out of the pump, to have the float trigger the pneumatic valve in the opposite direction, the compressed air entering the pump is shut off and the compressed air in the pump chamber is exhausted through the exhaust conduit, allowing the pump to fill again. In this manner the pump cycles until the fluid fails to fill the pump sufficiently to trigger the pneumatic valve or the pressure of the compressed air drops below the total developed head of the pump.

The advantage of this invention over the prior art is that it provides a reliable and versatile pump which can be used without adjustment due to pressure changes or the effects of chemical fumes from the fluids it is pumping.

Other objects of this invention will become apparent as the following specifications progresses, reference being had to the accompanying drawings for an illustration of the mechanism.

FIGS. *3a*, *3b*, *3c* and *3d* are a series of views showing the pneumatic valve mechanism in its two positions—exhaust and pressure—from both the air inlet and air exhaust valve sides of the pump.

FIG. 1A AND 1B SECTIONED VIEWS OF AUTOMATIC PUMP

Figure 1A:
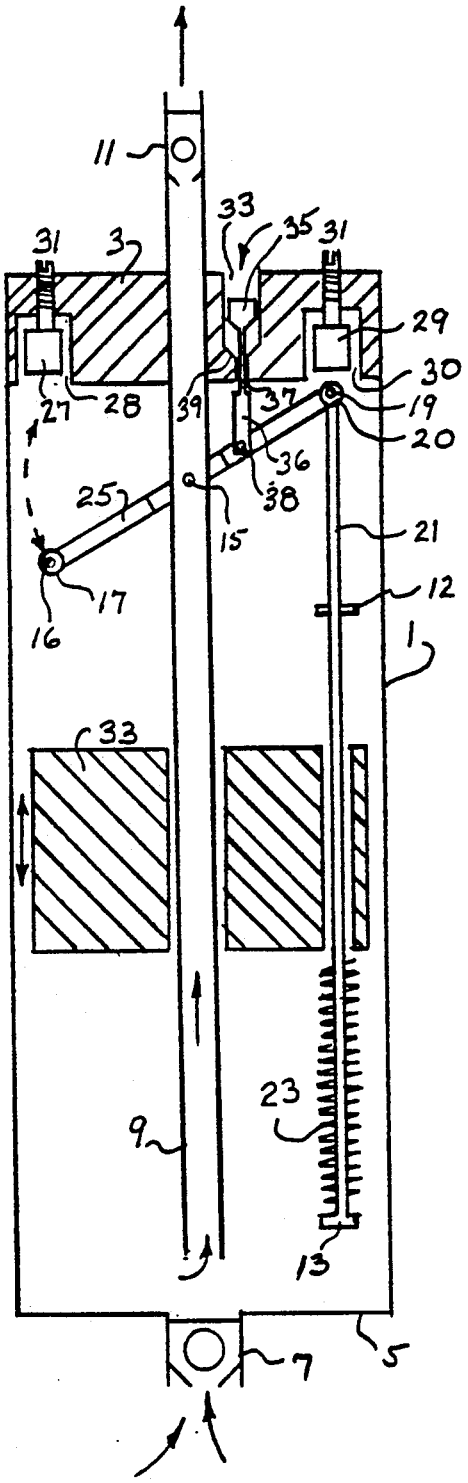
FIGS. 1A and 1B are sectioned views of the pump showing the air and fluid conduits, float actuator, check valves and pivot arm of the pneumatic valve and the inlet air poppet.
Figure 1B:
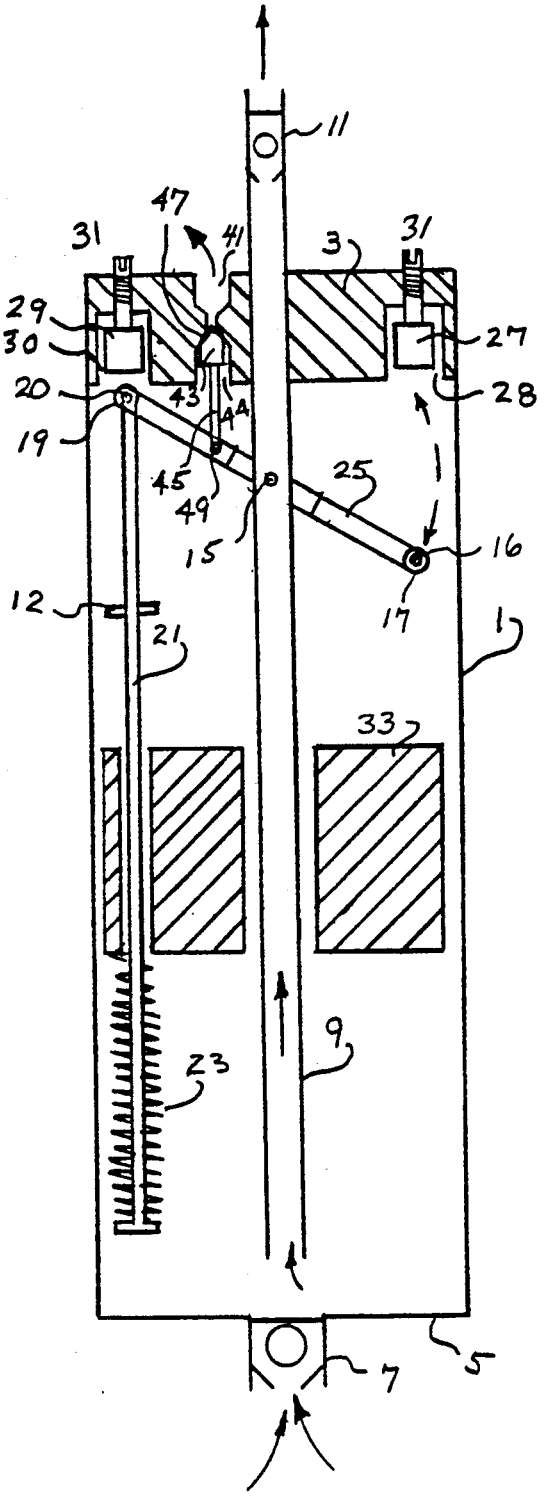

FIG 1A shows the inlet air valving side of the pump while FIG. 1B shows the exhaust air valving side of the pump. FIG. 1B is arranged as if the pump were turned around 180 degrees from FIG. 1A. The pump's outer extremities consist of an outer casing 1, a lower head 5 and an upper head 3. A check valve 7 mounted in the lower head 5 allows fluid to enter the pump and prevents it from leaving. A check valve 11 mounted at the uppermost extremity of the pump in the fluid discharge tube 9 allows fluid to pass out of the pump and not return. The means by which the fluid is allowed into the pump and forced out of the pump is the pressurization and the exhaust of the outer casing 1. Compressed air is introduced through the inlet poppet valve passage 37. This forces the fluid up through the fluid discharge conduit 9 and out through the upper check valve 11. When the fluid level inside the pump casing 1 nears the bottom of the pump, the float 33 compresses the spring 23 which presses against the stop 13 on the end of the control rod 21. When sufficient force is reached to dislodge the steel roller 20, which is mounted on the pivot arm 25 via a pin 19, from the magnetic attraction supplied by the inlet magnet 29, the pivot arm 25 begins to swing through an arc. This travel is kept in motion by the force of the compressed spring 23. At the end of the swing the pivot arm 25 stops when the other steel roller 17, mounted on the pivot arm 25 via a pin 16, hits the upper head 3 below the exhaust magnet 27. The force of the attraction of the magnets 27,29 is varied by turning the adjustment screws 31 above each magnet 27,29. These adjustment screws 31 are tapped into the upper head 3 and thus can be used to raise and lower the magnets 27, 29 in there respective chambers 28, 30 so that they are either closer or further away from the rollers 17, 20 when they are at rest against the upper head 3. These adjustments allow one to adjust for fluids of different specific gravities and to compensate for machining tolerances in the mechanism.

The swinging of the pivot arm 25 causes the inlet poppet 35, which is connected to the pivot arm 25 via a firmly fixed rod 36 and pivoting pin 38, to travel downward in its chamber 33 and eventually rest upon the inlet valve face 39 machined into the upper head 3. This closes off the input of compressed air. The swing of the pivot arm 25 also opens the pump to atmospheric pressure by dropping the exhaust poppet 43, which is connected to the pivot arm 25 via a firmly fixed rod 45 and pivoting pin 49 away from the exhaust valve face 47 machined into the upper head 3. Compressed air in the pump then exits the pump via the exhaust passage 41. When the pressure inside of the pump has been lowered below the hydrostatic pressure of the fluid outside of the pump, the lower check valve 7 opens to allow fluid into the pump again.

The fluid rises in the pump forcing the float 33 upwards towards the upper control rod stop 12. When the float 33 reaches the upper control rod stop 12 it pushes up on the control rod 21 and thus pushes up on the input roller 20. As the fluid rises further up inside the pump chamber 1 the upward force on the input roller 20 increases due to the submergence of the float 33 in the fluid. When this upward force becomes greater than the magnetic attraction between the exhaust roller 17 and the exhaust magnet 27, the pivot arm 25 will begin to swing. This movement pulls the exhaust roller 17 away from the exhaust magnet 27 and the pivot arm 25 swings until the inlet steel roller 20 rests near the input magnet 29. This action is kept in motion by the weight to the exhaust roller 17 which is heavier than the input roller 20. This pivoting action raises the input poppet 35 in the input air chamber 33, lifting the poppet off of the inlet valve face 39. This allows pressurized air to enter the pump and push the fluid out of the fluid discharge tube 9. The arc of the pivot arm has also caused the exhaust poppet 43 to be raised in its chamber 44 and thus contact the exhaust valve face 47, shutting off the escape of air from the exhaust port 41. This cycling continues until fluid fails to fill the pump or the pressure of the compressed air is insufficient to move the fluid.

FIG. 2 PLAN VIEW OF THE PIVOT ARM, FLUID DISCHARGE TUBE AND VALVES

Figure 2:
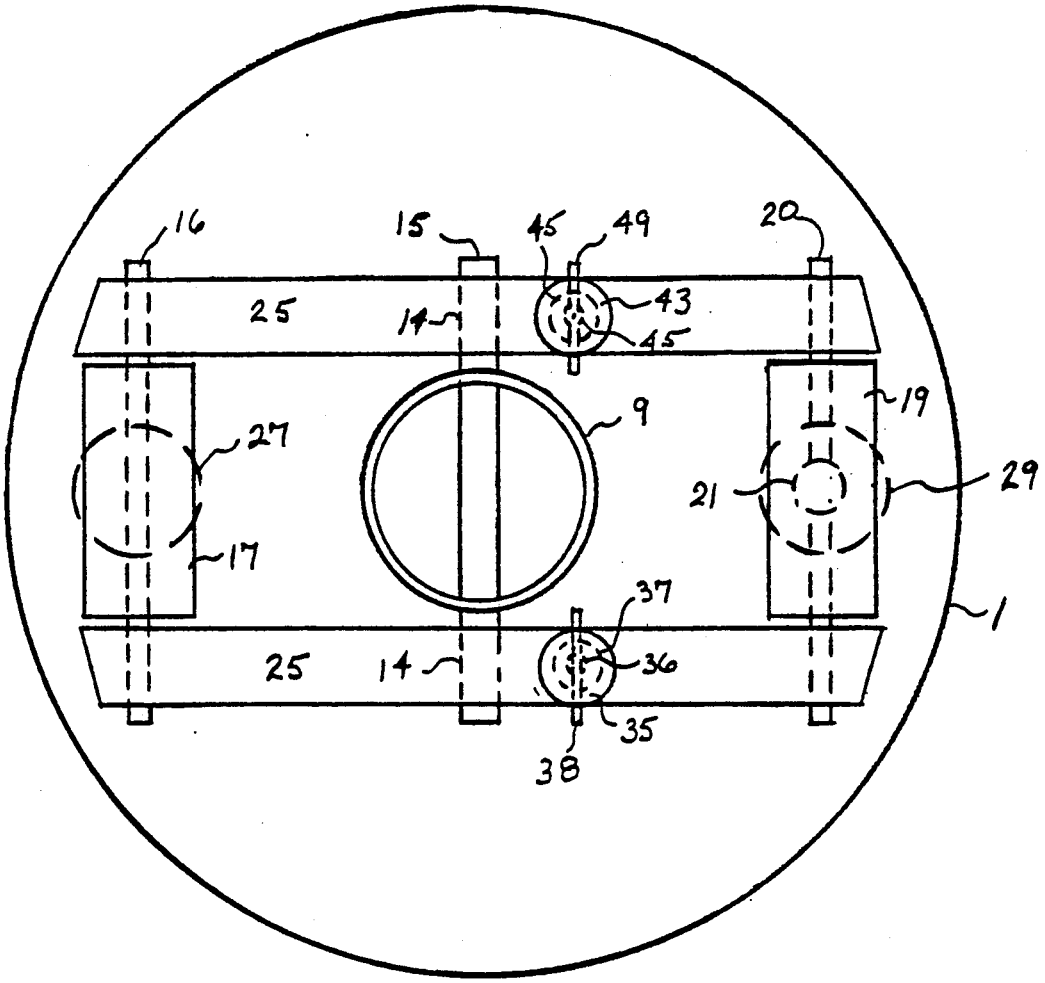
FIG. 2 is a plan view of the pneumatic valving and the pivot arm.

FIG. 2 shows the layout of the pivot arm 25 in relationship to the fluid discharge tube 9, the rollers 17, 19 the control rod 21, the input poppet 35, the exhaust poppet 43 and the magnets 27, 29.

The pivot arm 25 is held together with a pin 15 press fit into the fluid discharge tube 9, the pin 20 through the input roller 19 and the pin 16 through the exhaust roller 17. The roller pins 16, 20 can be held in place using typical spring clips on their ends. The pivot arm pin 15 is mounted loosely in a hole 14 the pivot arm 25 so the pivot arm 25 can easily swing.

The input poppet 35 and the exhaust poppet 43 are both located to one side of the pivot arm pin 15. This offset from the pivot arm pin 15 provides the leverage and the vertical travel necessary for the pivot arm 25 to move the poppets 35, 43. The exhaust poppet 43 is connected to the pivot arm via a rod 45 and a pin 49. The pin 49 allows the rod 45 and exhaust poppet 43 to pivot slightly as the pivot arm 25 swings through its arc. The input poppet 35 is also attached to the pivot arm 25 via a rod 36 and a pin 38. This pin 38 allows the input poppet 35 and rod 36 to pivot freely as the pivot arm 25 swings through its arc.

The input magnet 29 is located in the center and directly over the resting location of the input roller 19. The exhaust magnet 27 is located in the center of and directly over the resting location of the exhaust roller 17. This allows the rollers 17, 19 to be held by their respective magnets 27, 29 when the rollers 17, 19 are in the raised resting position.

FIG. 3A, 3B, 3C AND 3D SECTIONED VIEWS OF THE PIVOT ARM AND VALVING MECHANISMS IN THE PRESSURIZING AND EXHAUSTING POSITIONS

Figure 3A:
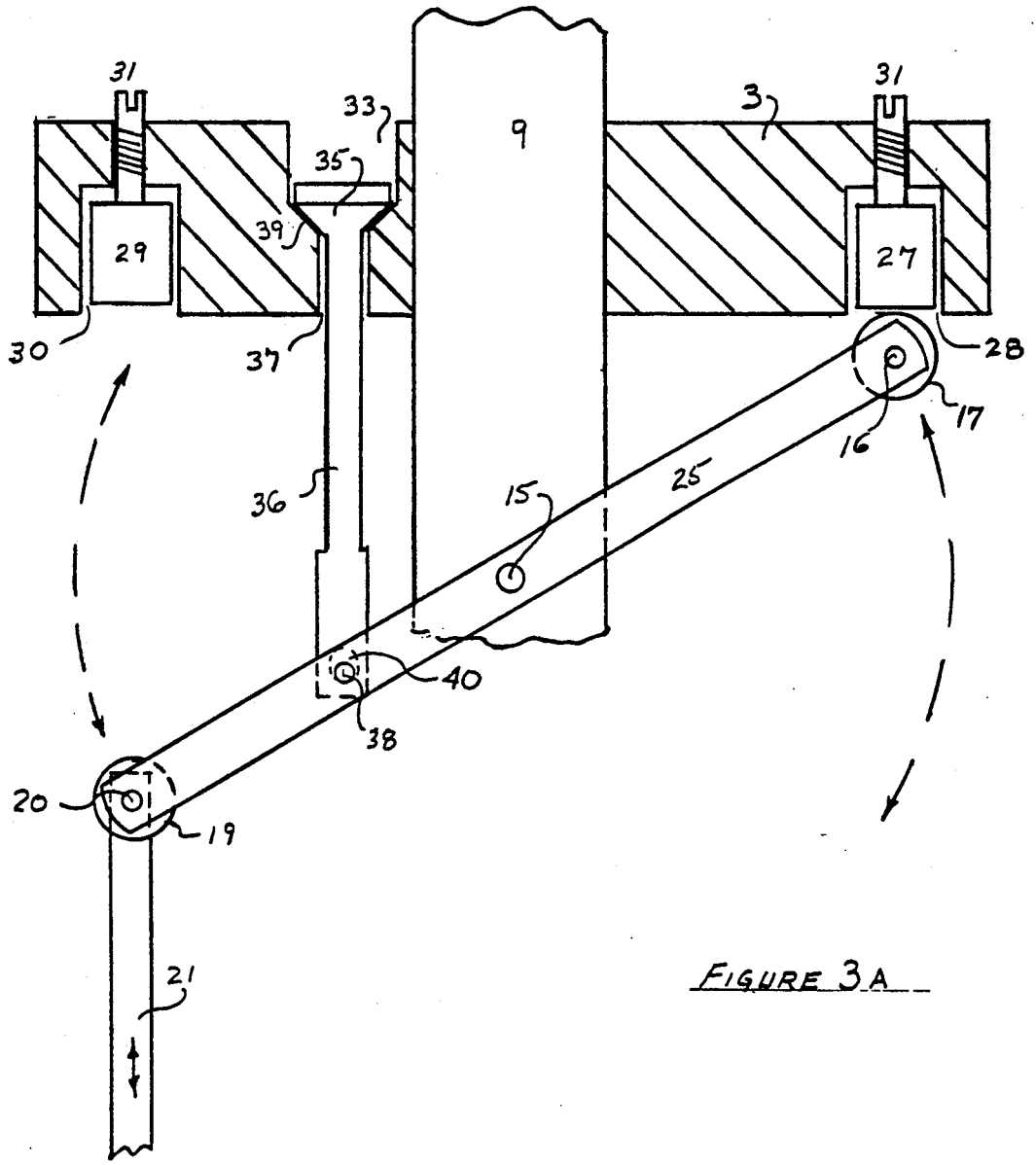

FIG. 3A shows the input poppet 35 side of the pump with the mechanism in the exhaust mode. It shows the pivot arm 25 with the exhaust roller 17 raised and resting on the upper head 3 directly below the exhaust magnet 27. In this position the exhaust roller 17 is held in place by the magnetic attraction of the exhaust magnet 27. The input poppet 35 is in its lowered position and is mated against the input valve face 39. The input poppet rod pin 38 which passes through the slotted hole 40 in the input poppet rod 36 and the pivot arm 25 is pulling the input poppet 35 down on the input valve machined face 39. This shuts off the entrance of compressed air into the pump through the input port 33. The slotted hole 40 in the input poppet rod 36 allows the pivot arm 25 to be moving into its arc before the input poppet 35 is raised from the input valve machined face 39. This ensures the pivot arm 25 has sufficient momentum to break away from the exhaust magnet 27 and for the input roller 20 to travel to the input magnet 29.

Figure 3B:
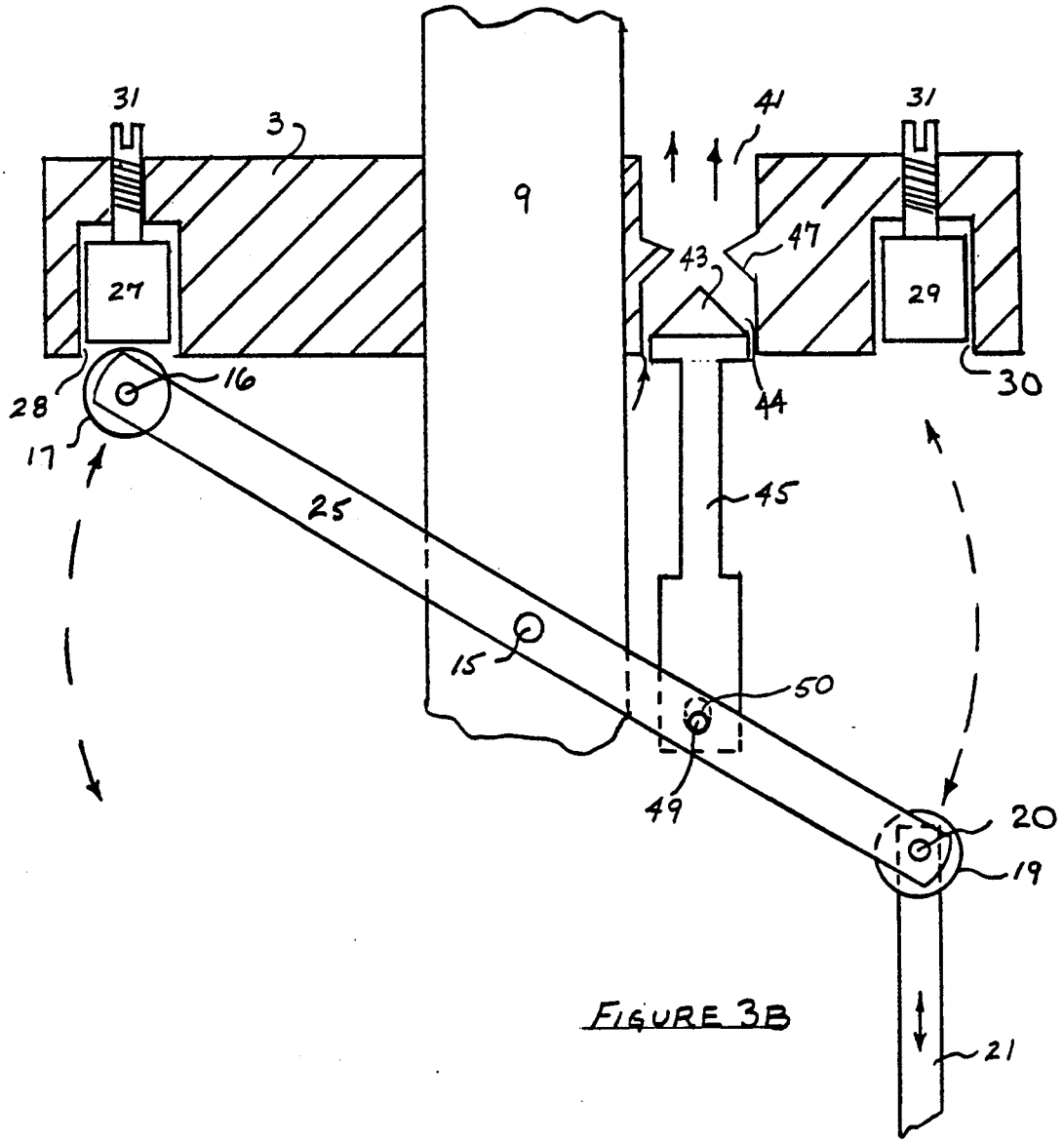

FIG. 3B shows the exhaust poppet 43 side of the pump with the mechanism in the exhaust mode. It shows the pivot arm 25 with the exhaust roller 17 raised and resting on the upper head 3 directly below the exhaust magnet 27. In this position the exhaust roller 17 is held in place by the magnetic attraction of the exhaust magnet 27. The exhaust poppet rod pin 49 which passes through the slotted hole 50 in the exhaust poppet rod 45 and the pivot arm 25 has pulled the exhaust poppet 43 down from the exhaust valve machined face 47. The exhaust poppet 43 is and away from the exhaust valve seat 47 allowing any pressurized air below the upper head 3 to exhaust through the exhaust port 41. The pump would now be filling with fluid, if it were present. The slotted hole 50 in the exhaust poppet rod 45 allows the pivot arm 25 to be moving into its arc before the exhaust poppet 43 is raised into the exhaust conduit 41. This ensures the pivot arm 25 has sufficient momentum for the exhaust roller 17 to break away from the exhaust magnet 27 and for the input roller 19 to travel all of the way to the input magnet 29 thus closing off the exhaust conduit 41 so pressurized air can pass through the head 3 and push the fluid out through the fluid discharge tube 9 and not escape through the exhaust conduit 41.

Figure 3C:
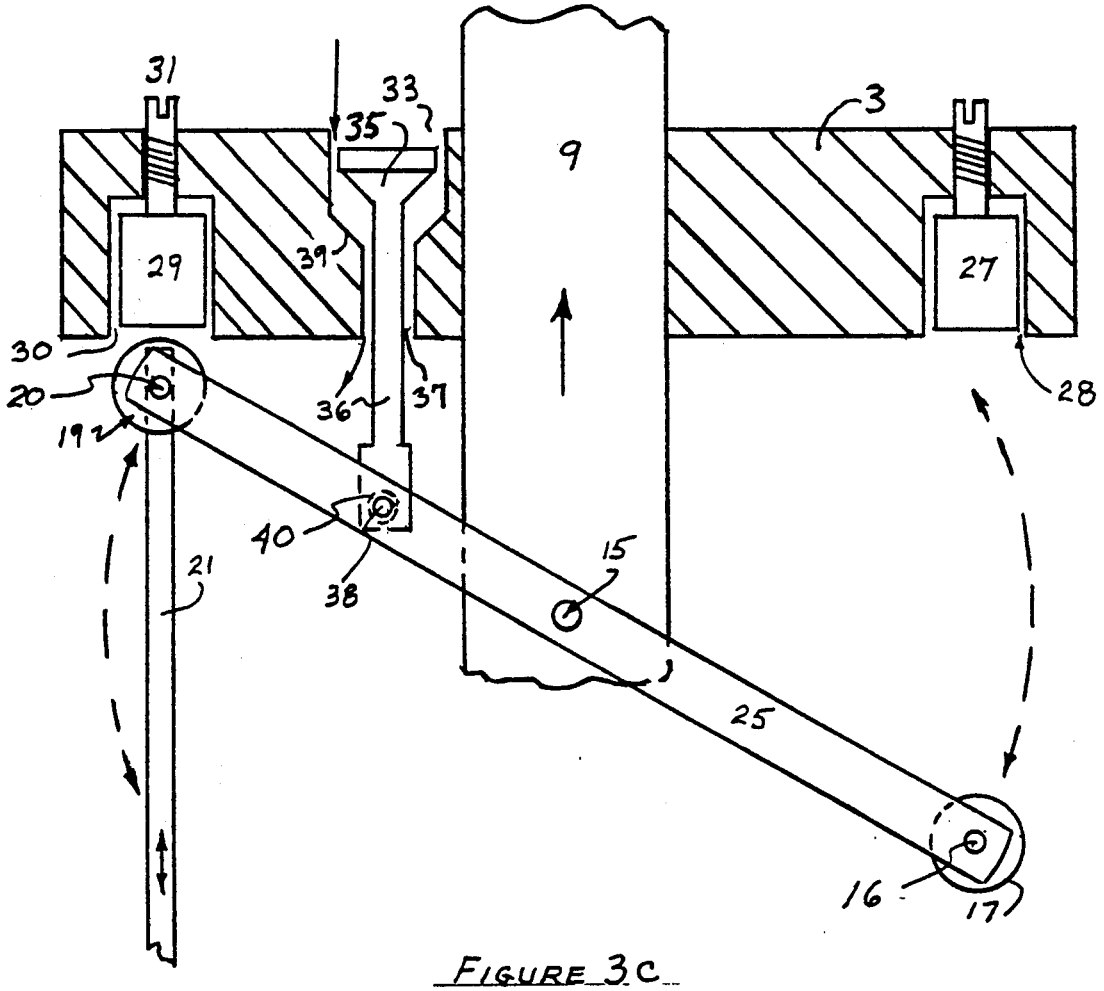

FIG. 3C shows the input poppet 35 side of the pump with the mechanism in the pressurization mode. It shows the pivot arm 25 with the input roller 19 raised and resting on the upper head 3 directly under the input magnet 29. In this position the input roller 19 is held in place by the magnetic attraction of the input magnet 29. The input poppet 35 is raised off of the input valve face 39 allowing compressed air to flow through the input port 33 to the pump below. With the mechanism thus arranged, compressed air is allowed to pass through the head 3 and force the fluid in the pump up and out of the fluid discharge tube 9.

Figure 3D:
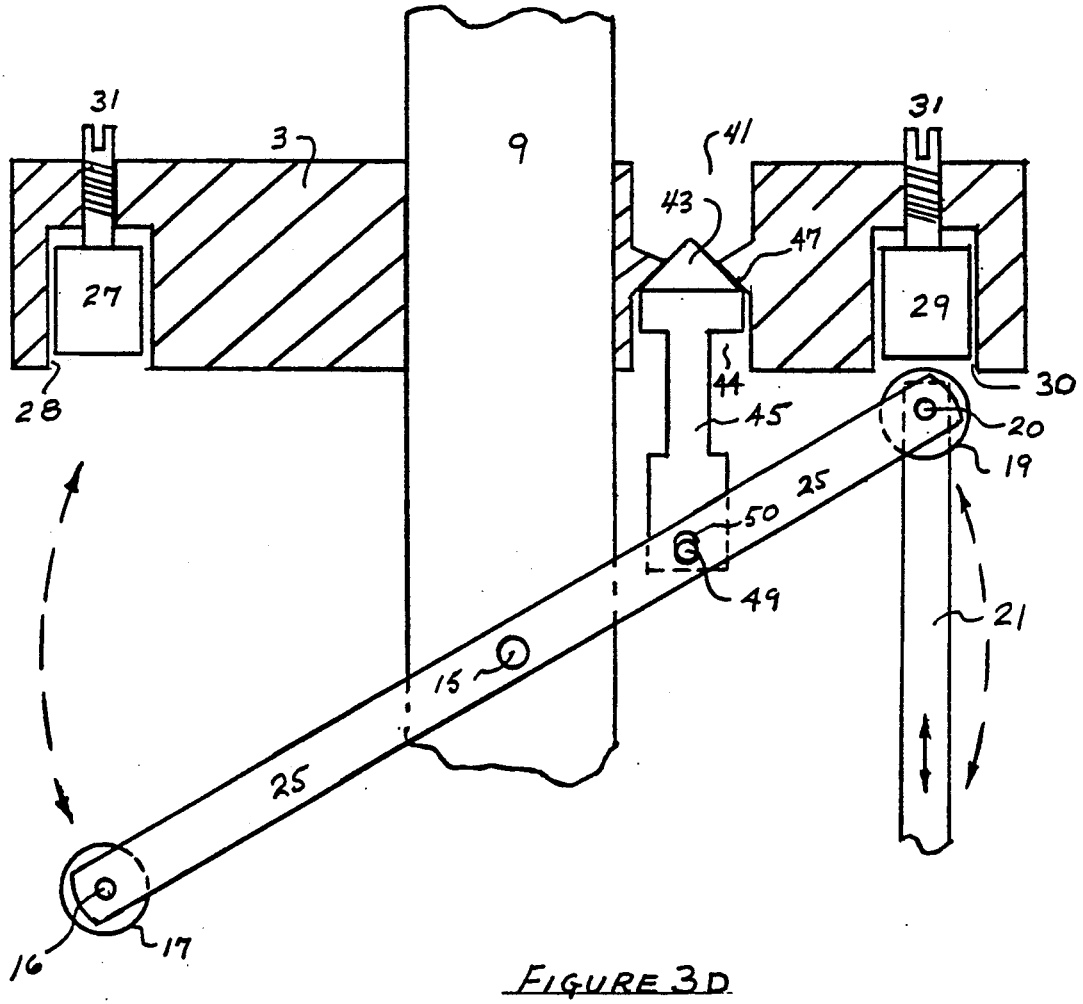

FIG. 3D shows the exhaust poppet 43 side of the pump with the mechanism in the pressurization mode. It shows the pivot arm 25 with the input roller 19 raised and resting on the upper head 3 directly under the input magnet 29. In this position the input roller 19 is held in place by the magnetic attraction of the input magnet 29. The exhaust poppet 43 is raised and is pressing against the exhaust valve face 47 preventing any flow through the exhaust port 41. With the mechanism thus arranged, no gas can escape through the exhaust port 41. Any compressed gas entering the pump head 3 will push the fluid up and out the fluid discharge tube 9.

CONCLUSIONS AND SCOPE

Thus it can be seen that fluids can be pumped from a sump or well using a pump comprised of an outer chamber with an inlet check valve in order to fill the pump with fluid and a fluid discharge conduit with an outlet check valve for emptying the pump, a float and a pivoting arm which activates a pneumatic poppet valves inside the pump chamber.

The advantages of this system over the prior art is that the pump can continue to function through a wide range of supply air pressure. Also it can function without stuttering due to rapid influx of fluid in through its lower inlet. In addition, this pump provides an advance in the state of the art in that it has virtually no way of becoming stuck in mid-cycle due to pressure changes in air supply.

Further, this invention is powered by compressed air which eliminates the sparking hazards of electrically powered pumps. Thus it is seen that the present invention provides a novel, lightweight, economical, highly reliable, pumping mechanism which can be easily manufactured, installed, used and removed by persons with a minimal amount of knowledge in the field of pumping fluids. The present invention has the capacity to save millions of dollars in maintenance of pumps and work time lost due to electrical shock injuries from electrical sump and well pumps.

While the above description contains many specificities, the reader should not construe these limitations on the scope of the invention, but merely as exemplifications of preferred embodiments thereof. Those skilled in the art will envision many other possible variations are within its scope. Accordingly the reader is requested to determine the scope of the invention by the appended claims and their legal equivalents, and not by the examples which have been given.

What is claimed is:

1. Apparatus for the pumping of fluids using compressed gases comprising:

an outer casing an inlet including means for allowing fluid in but not out, a hollow fluid discharge tube having its lower end open near the lowermost area of said casing and extending upward and having means for allowing fluid out of said casing but not in, a housing having means for mounting a plurality of air valves and magnets, a pivoting arm having means to be fixed adjacent said housing on a pivot pin and having steel rollers fixed to both ends, said pivot arm being able to pivots through an arc during the activation of said pump, the end points of said arc being located where said steel rollers on said pivot arm contact said housing, two magnets positioned in said housing in a position to attract at least one of said steel rollers at each extreme of said arc, said pivot arm having means for attachment to an air inlet poppet valve assembled in a conduit, in said housing, which connects a pressurized air source to the inner area of said casing, said pivot arm also having means for attachment to an air exhaust poppet valve assembled in a conduit, in said housing, which connect the inner area off said casing with atmospheric pressure, said air inlet poppet valve being machined to mate against an input valve machined face when lowered vertically by said pivot arm to completely shut off said gasses from entering said chamber and when raised by said pivot arm to rise of said input valve machined face and allow said gasses to enter said chamber, said air exhaust poppet valve being machined to mate against an exhaust valve machined face, said pivot means to raise and lower said poppet valves onto and off of said machined faces, said means for attachments to said poppet valves being offset from the longitudinal centerline of said pin in said pivot arm, said pivot arm having means for a control rod to be connected to one of its ends via a pivot pin and extending downward, said control rod passing slidingly through a float which is buoyant in the fluid being pumped, said control rod having a stop near its upper extremity and another at its lower extremity and said float being positioned between said stops, whereby said pivot arm at each extreme of said arc is held in position by at least one of said magnets, and whereby movement of said float against said stops actuates said control rod, thereby pivoting said pivot arm of said valve means through said arc to cause said pivot arm to rest alternately at each extreme of said arc to alternately pressurize and exhaust said chamber through actuation of said poppet valves.

2. Apparatus as set forth in claim 1, further including a coiled spring wrapped around said control rod and located between said lower control rod stop and the bottom of said float.

3. Apparatus set forth in claim 1, further including said rollers on said pivot arm being of different weights, with the heavier of said rollers mounted on said pivot arm on the opposite end of said pivot arm that said control rod is attached to said pivot arm.

4. Apparatus as set forth in claim 1, further including said pivot arm being pinned to said fluid discharge tubing.

5. Apparatus as set forth in claim 1, further including said float having longitudinal bores, and being mounted on said fluid discharge tube and on said control rod.

* * * * *

UNITED STATES PATENT AND TRADEMARK OFFICE

Certificate

Patent No. 5,004,405 Patented: April 2, 1991

On petition requesting issuance of a certificate for correction of inventorship pursuant to 35 U.S.C. 256, it has been found that the above-identified patent, through error and without deceptive intent, improperly sets forth the inventorship.

Accordingly, it is hereby certified that the correct inventorship of this patent is: Michael K. Breslin, Mill Valley, CA; and Kevin Manning, Oakland, CA.

Signed and Sealed this Twenty-first Day of March, 2000.

TIMOTHY S. THORPE
*Supervisory Patent Examiner*
Art Unit 3746